US006705931B2

(12) United States Patent
Moolenaar et al.

(10) Patent No.: US 6,705,931 B2
(45) Date of Patent: Mar. 16, 2004

(54) PLANE SANDER WITH EXCHANGEABLE PART OF SANDING SOLE

(75) Inventors: Antonie Johannes Moolenaar, Dorst (NL); Ruben Jan Moerbeek, Breda (NL)

(73) Assignee: Skil Europe B.V., Breda (NL)

( * ) Notice: Subject to any disclaimer, the term of this patent is extended or adjusted under 35 U.S.C. 154(b) by 0 days.

(21) Appl. No.: 09/883,209

(22) Filed: Jun. 19, 2001

(65) Prior Publication Data

US 2001/0055944 A1 Dec. 27, 2001

(30) Foreign Application Priority Data

Jun. 21, 2000 (NL) ..... 1015488

(51) Int. Cl.[7] ..... B24B 23/00

(52) U.S. Cl. ..... 451/357; 451/342; 451/344; 451/358; 451/353; 451/359

(58) Field of Search ..... 451/342, 344, 451/353, 357, 358, 359, 363, 356, 490, 495, 526, 527, 529, 538, 539

(56) References Cited

U.S. PATENT DOCUMENTS 5,470,272 A * 11/1995 Kikuchi et al. ..... 451/344
5,533,926 A * 7/1996 Nemazi ..... 451/490
5,681,213 A * 10/1997 Hashii ..... 451/356
5,743,791 A * 4/1998 Bosten et al. ..... 451/356
5,885,146 A * 3/1999 Cockburn ..... 451/357
5,967,886 A * 10/1999 Wuensch et al. ..... 451/356
6,007,414 A * 12/1999 Tsai ..... 451/351
6,045,887 A * 4/2000 Martin et al. ..... 428/43
6,165,060 A * 12/2000 Martin et al. ..... 451/356
6,186,878 B1 * 2/2001 Takizawa et al. ..... 451/357

FOREIGN PATENT DOCUMENTS

DE 85358865 U1 2/1986
DE 29614325 U1 10/1996
EP 0 925 876 A2 6/1999

* cited by examiner

*Primary Examiner*—Lee D. Wilson
(74) *Attorney, Agent, or Firm*—Banner & Witcoff Ltd.

(57) ABSTRACT

A sanding machine comprises a housing with a drive arranged in the housing. A substantially flat sanding sole having a main plane is mounted on the housing for movement in the main plane. The sanding sole is adapted to drive in an oscillating movement. The sanding sole has a first part on which the drive engages and a second part adjacent to the first part, which is releasably connected to the first part. The second part can be removed and replaced with a third part, the third part being releasably connected to the first part. The third part can be an additional sanding surface or a base for another tool. A sanding element for use in a sanding machine in the form of a sanding sole assembled from a first part and a second part.

25 Claims, 3 Drawing Sheets

PLANE SANDER WITH EXCHANGEABLE PART OF SANDING SOLE

FIELD OF THE INVENTION

The invention relates to a sanding machine, comprising a housing with drive means arranged in the housing, a substantially flat sanding sole which is mounted on the housing for movement in its main plane, wherein the drive means are adapted to drive the sanding sole in a reciprocating movement, wherein the sanding sole comprises a first part on which the drive means engage and comprises a second part adjacent to the first part which is releasably connected to the first part.

BACKGROUND OF THE INVENTION

Such a sanding machine is known from the brochure "Catalogue of D.I.Y. tools 1999–2000" of Black & Decker.

Such a sanding machine is shown in this catalogue, wherein a part of the sole is embodied separately. In the present case this is a tip of the sole of the sanding machine.

This tip is the part of the sole where the sandpaper wears most. When the foremost tip of the sandpaper is worn, the relevant part of the sole can for instance be rotated a half-turn in order to place a less worn piece of sandpaper at the tip.

The object of this measure known from the prior art is better use of the sandpaper.

There is however a need for a sanding apparatus, wherein the shape of the sanding sole is adaptable. This would provide the possibility of being able to use a rectangular sole for sanding for instance large surfaces, and of using a sanding sole provided with a tip for sanding corners which are difficult to reach.

There is a further need for a sanding apparatus with which operations other than sanding can also be performed, both separately and in combination.

The object of the present invention is to provide such a sanding machine.

SUMMARY OF THE INVENTION

This object is achieved with a sanding machine according to the preamble of the main claim, wherein the second part can be replaced by a third part to be arranged releasably adjacently of the first part. This third part can be used as additional sanding surface, but also as a base for another tool.

According to a first preferred embodiment the third part therefore has a shape different from that of the second part.

This provides the possibility of adapting the shape of the sanding sole or the other tool to the desired use.

According to a special preferred embodiment the second part is provided with a tool for performing an operation other than sanding.

This embodiment makes it possible to make use of the drive of the sanding machine to perform a second type of operation.

The tool is preferably a chisel.

According to another preferred embodiment the bottom surface of both parts lies in the same plane.

A single sanding surface is hereby obtained, the shape of which can be adapted.

According to another preferred embodiment the first, the second and the third part of the sanding sole all have a rigid layer and a layer arranged thereunder which is compressible in the thickness direction, the drive means engage on the rigid layer of the first part, and the rigid layer of the second and the third part of the sanding sole can be connected to the rigid layer of the first part of the sanding sole by means of at least one locking connection.

This measure provides the option in the configuration according to the present invention of also making use of a sanding sole provided with a layer which is compressible in the thickness direction. With these measures it is possible to form a firm connection between the first part and the second respectively the third part of the sanding sole, so that the second respectively third part of the sanding sole are also driven together with the first part, while the abrasive material performing the sanding action is connected to the rigid part of the sanding sole via a layer of material compressible in the thickness direction.

According to another preferred embodiment the rigid layer of the second and the third part of the sanding sole can be connected to the rigid layer of the first part of the sanding sole by means of at least one hook connection and at least one locking connection.

This construction results in a connection engaging at least at two points between the first part and the second part respectively the third part of the sanding sole, while the locking connection enables an easy release.

The same advantage, although to an even further extent, results when the rigid layer of the second and the third part of the sanding sole is connected to the rigid layer of the first part of the sanding sole by means of two hook connections and a locking connection, and the movable lock of the locking connection is connected to the first part of the sanding sole.

According to another preferred embodiment the layer compressible in its thickness direction of at least the first part of the sanding sole is releasably connected to the rigid layer of the sanding sole.

This measure provides the possibility of replacing the compressible part of the sanding sole, for instance after wear.

The layer compressible in its thickness direction is preferably connected reversibly to the rigid layer of the sanding sole.

The turning over can also be used to move heavily loaded, worn surfaces of the layer to locations less subject to wear.

The compressible layer is preferably connected to the rigid layer of the sanding sole by means of velcro material.

According to yet another preferred embodiment, each of the parts of the sanding sole can be coupled to a substantially fitting sanding element.

A sanding element is understood to mean not only a sheet of sandpaper or sand cloth, but for instance also a thin layer of a material which itself has sanding properties.

This measure enables separate sanding elements to be used for each part of the sanding sole. During use of for instance the first and the second part of the sanding sole it is then possible, if for instance only the sanding element of the second part is worn, to replace only this part of the sanding element.

It will otherwise be apparent that it is likewise possible to use sanding elements which fit as a whole onto the combination of first and second or first and third parts of the sanding sole.

According to yet another preferred embodiment each of the parts of the sanding sole is provided on its underside with fastening means for effecting a releasable attachment between the sanding element and the relevant part of the sanding sole.

This measure results in an easy arrangement and release of the sanding element, without difficult fixing processes having to be performed for this purpose.

The parts of the compressible layer of the sanding sole are preferably provided with a layer of velcro material for attachment to a sanding element.

This results in a simple and inexpensive manner of providing such an attachment.

According to a specific embodiment the velcro material comprises a durable layer and a less durable layer, the sanding sole is provided with the durable layer of the velcro material and the abrasive is provided with the less durable layer of the velcro material.

This offers the advantage of manufacturing the sanding element from the cheapest fastening material; this must after all be replaced frequently.

According to yet another preferred embodiment channels are arranged in the sanding machine for extracting air from the vicinity of the sanding sole, wherein the channels extend through the parts of the sanding sole.

This measure extracts the air and the sanding dust created during sanding at the position where it occurs, so that the sanding system is thus the most effective.

According to yet another embodiment the compressible layers are arranged releasably on the rigid parts.

This provides the advantage that, when a section of the durable part of the velcro connection is worn after repeated replacement of the abrasive material, it can be repositioned, so that a less worn part comes to lie at the position which is subject to the most wear. It is also possible to entirely replace the compressible whole.

According to yet another preferred embodiment the connection between the rigid parts and the compressible layers is obtained by means of velcro material.

The connection between the rigid parts and the compressible layer is preferably better than the connection between the compressible layer and the abrasive.

The invention also relates to a sanding element for use in a sanding machine according to any of the foregoing claims, which sanding element is characterized in that the sheet substantially takes the form of a sanding sole which is assembled from a first part and a second part or a first part and a third part of the sanding sole.

The advantage is thus achieved that the whole effective sanding sole is provided with an integral sanding element, for instance a sheet of sandpaper, so that the occurrence of folds and such phenomena are avoided.

According to yet another preferred embodiment the sanding element is provided with a perforation line, which is displaced relative to the separation between the first part and the second part of the sanding sole. Release at the seam is hereby prevented.

It is also attractive for the sanding element to take the form of the combined sanding sole with the omission of a commercially standard sanding element.

The part of the abrasive material most subject to wear can hereby be easily replaced by a standard commercially available abrasive material.

Other attractive preferred embodiments are stated in the remaining sub-claims.

BRIEF DESCRIPTION OF THE DRAWINGS

The present invention will be elucidated hereinbelow with reference to the annexed figures, in which.

DETAILED DESCRIPTION OF THE INVENTION

Figure 1:
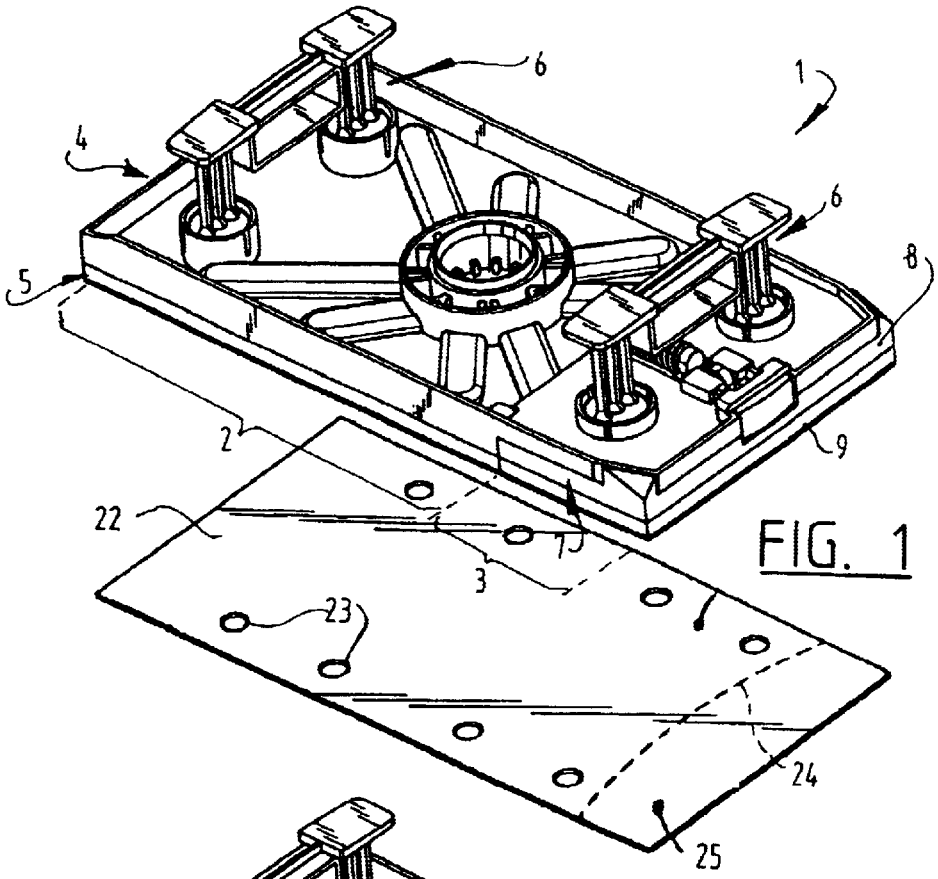
FIG. 1 is a perspective view of a sanding sole of a sanding machine according to the present invention, wherein the second part of the sanding sole is fixed to the first part.

FIG. 1 shows a sanding sole 1 which is formed by a first part 2 and a second part 3. The first part 2 of the sanding sole is formed by a rigid element 4 and an element 5 manufactured from material compressible in its thickness direction. Rigid element 4 is for instance manufactured from aluminium or a plastic. The rigid element 4 of the sanding sole is connected to the housing (not shown in the drawings) of the sanding machine by means of two coupling pieces 6. Both connecting elements take the form of a portal and are fixedly connected to the rigid element of the first part of the sanding sole.

For driving of the sanding machine an electric motor (not shown) is placed in the housing, which motor is provided with a crank which engages in a ring 17 arranged on rigid element 6 of the sanding sole.

On one side the rigid element 4 is provided with a stepped recess 7. Here space is made for arranging the second part 3 of the sanding sole. This second part 3 is once again formed by a rigid element 8 and a compressible element 9.

Figure 2:
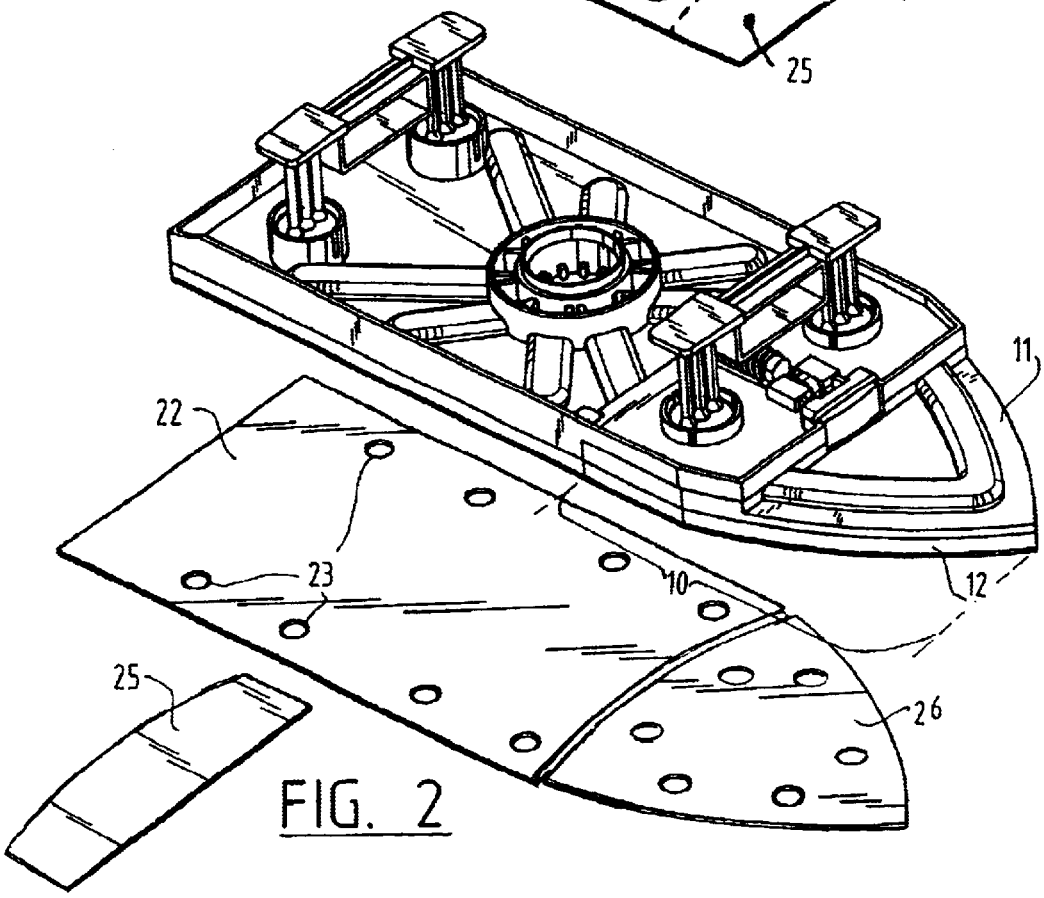
FIG. 2 shows a view similar to FIG. 1, wherein the third part of the sanding sole is fixed to the first part.

As shown in FIG. 2, it is possible to replace the second part 3 of the sanding sole with a third part 10. It is pointed out here that the third part 10 has a form differing from that of second part 3. The combination of first part 2 and second part 3 of the sanding sole results in a sanding sole with a rectangular shape, while the combination of first part 2 and third part 10 results in a sanding sole which is substantially rectangular, but which tapers off to a point on one narrow side. With the pointed shape it is easy to sand in enclosed cavities and spaces. The invention thus provides the option of adapting the shape of the sanding sole to the shape of the object for sanding.

The third part 10 of the sanding sole is also formed by a rigid element 11 and a compressible element 12.

The rigid element 11 is connected to rigid element 4 by means of a locking connection 13. This takes place in the same manner as in the situation drawn in FIG. 1, wherein rigid element 8 is connected to rigid element 4 by means of the lock 13.

Figure 3:
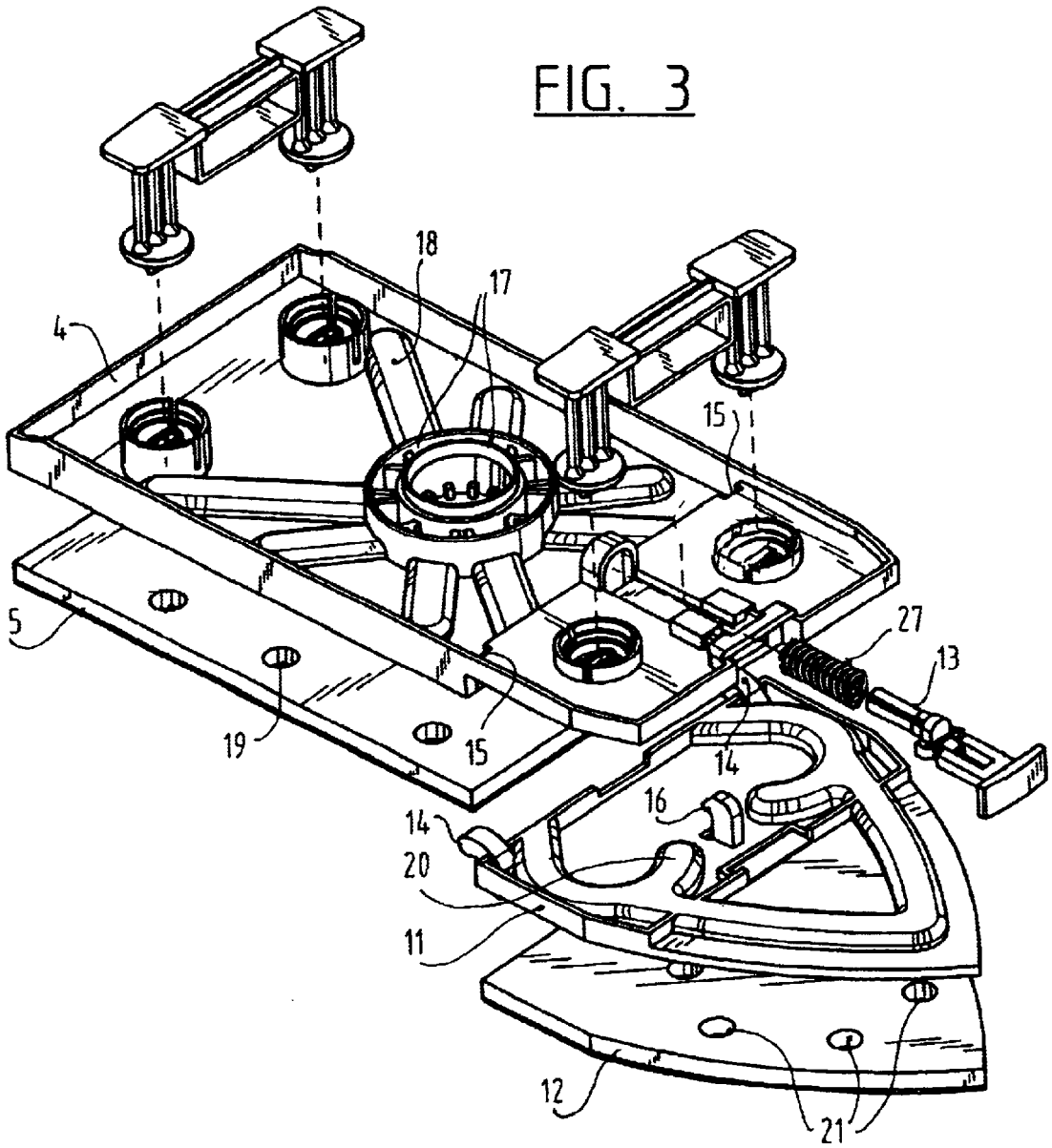
FIG. 3 is an exploded view of the sanding sole shown in FIG. 2.

FIG. 3 further shows how the fixing between rigid element 4 and rigid element 11 is effected; rigid element 11 which, as rigid element 4, is manufactured from for instance aluminium, is provided with two hooks 14 which engage in openings 15 arranged in rigid element 4. Further arranged on rigid element 11 is a locking hook 16 30 which, when situated at the correct position, can be engaged by the lock 13.

With the thus shown construction it is possible to impart different shapes to the sanding sole as required. Only two different shapes are shown here in the present embodiment; it will be apparent that more shapes are possible.

In order to extract the dust created during sanding use is made of an extraction device which forms part of the actual sanding machine and which is not shown in the present drawings. Made in rigid element 4 of the sanding sole for the purpose of extracting the dust is a connection 17 to which extraction means accommodated in the sanding machine can be connected. Connection 17 leads to a number of radially extending channels which at their end debouch into an opening. This opening connects to extraction openings 19 arranged in compressible element 5. In similar manner two of the channels IS lead to the stepped recess 7. At an arranged second part 3 or a third part 10 they there debouch into channels 20, which are connected to openings 21 arranged in flexible element 12. It is thus possible to extract the dust originating from the sanding sole over the whole surface thereof.

The compressible parts 5, 9 and 12 can further be permanently or releasably connected to rigid parts 4, 7 respectively 12.

Attention is finally drawn to the form of the sandpaper for arranging on the sanding sole of the sanding machine according to the present invention.

As shown in FIG. 1, this can be formed by a rectangular sheet 22 which at the position of openings 15 and 21 in the sanding sole is of course provided with corresponding openings 23 for extracting the dust. The shape of the sheet of sandpaper 22 is herein the same as the shape of the combination of the first and the second part of the sanding sole.

As also shown in FIG. 1, it is for instance possible to arrange a perforation line 24 in the sheet of sandpaper 22 which is displaced relative to the separation between the two parts. This provides the option of removing the relevant part 25 from the sheet of sandpaper 22. As FIG. 2 shows, it is then possible to replace the removed part 25 with a part 26 having a shape which is adapted to the shape of the third part of the sanding sole. This part is preferably formed by a commercially obtainable piece of sandpaper.

A sanding element is of course understood to mean sandpaper, but it will be apparent that this can also include different abrasive carriers such as sand cloth and the like.

In order to attach the sandpaper to the sanding sole use can be made of velcro material. This avoids the inconvenience of prior art clamping devices. Such clamping devices are moreover difficult to apply in the present configuration.

It is herein possible to provide the sanding sole with the most durable layer of the velcro material, and to provide the sheets of sandpaper which are to be replaced most often with the less durable layer. This is of course a question of cost price.

Figure 4:
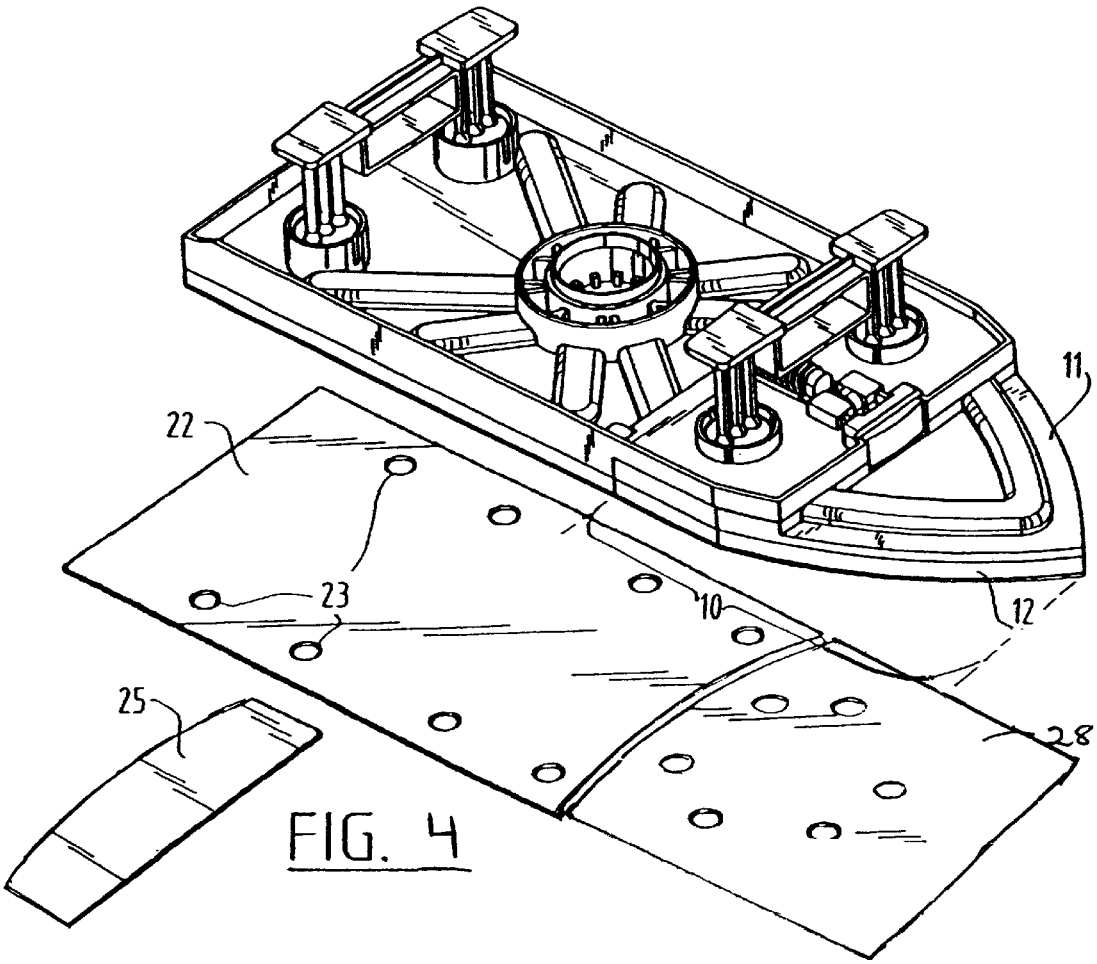

FIG. 4 depicts the sanding machine with a second part having a tool 28 for performing an operation other than sanding. The tool may be a chisel.

What is claimed is:

1. Sanding machine comprising a housing with drive means arranged in the housing, a substantially flat sanding sole having a main plane which is mounted on the housing for movement in the main plane, wherein the drive means are adapted to drive the sanding sole in an oscillating movement, wherein the sanding sole comprises a first part having a rigid portion on which the drive means engage and a second part having a rigid portion adjacent to the first part which is releasably connected to the first part, wherein the second part can be removed and replaced with a third part having a rigid portion, the third part being releasably connected to the first part, wherein the second part and the third part have different shapes, and wherein bottom surfaces of the first part and of the second part, or of the first part and of the third part, lie in the same plane.

2. Sanding machine as claimed in claim 1 wherein the second part is provided with a tool for performing an operation other than sanding.

3. Sanding machine as claimed in claim 1 wherein the first part, the second part, and the third part of the sanding sole each have a layer arranged under each rigid layer which is compressible in its thickness direction, that the drive means engage on the rigid layer of the first part, and that the rigid layer of the second part and the rigid layer of the third part of the sanding sole can be connected to the rigid layer of the first part of the sanding sole by means of at least one locking connection.

4. Sanding machine as claimed in claim 3 wherein the rigid layer of the second part and the rigid layer of the third part of the sanding sole can be connected to the rigid layer of the first part of the sanding sole by means of at least one hook connection and at least one locking connection.

5. Sanding machine as claimed in claim 4 wherein the rigid layer of the second part and the rigid layer of the third part of the sanding sole are connected to the rigid layer of the first part of the sanding sole by means of two hook connections and a locking connection having a movable lock, and wherein the movable lock is connected to the first part of the sanding sole.

6. Sanding machine as claimed in claim 3 wherein the layer compressible in its thickness direction of at least the first part of the sanding sole is releasably connected to the rigid layer of the sanding sole.

7. Sanding machine as claimed in claim 6 wherein the layer compressible in its thickness direction is connected reversibly to the rigid layer of the sanding sole.

8. Sanding machine as claimed in claim 6 wherein the compressible layer is connected to the rigid layer of the sanding sole by means of velcro material.

9. Sanding machine as claimed in any of the claim 6 wherein the parts of the compressible layer of the sanding sole comprises a layer of velcro material for attachment to abrasive material.

10. Sanding machine as claimed in claim 9 wherein the Velcro material comprises a durable layer and a less durable layer, that the sanding sole is provided with the durable layer of the velcro material and the carrier sheet for abrasive material is provided with the less durable layer of the velcro material.

11. Sanding machine as claimed in claim 1 wherein each of the parts of the sanding sole can be coupled to a substantially fitting sanding element.

12. Sanding machine as claimed in claim 11 wherein each of the parts of the sanding sole comprises a fastening means on its underside for effecting a releasable attachment between the sanding sole and extending over the whole surface of the sanding sole.

13. Sanding machine as claimed in claim 1 wherein channels are arranged in the sanding machine for extracting air from the vicinity of the sanding sole, wherein the channels extend through the parts and the layers of the sanding sole.

14. Sanding machine as claimed in claim 1 wherein the rigid layer of the sanding sole is provided on its underside with assist means for positioning the abrasive material to be arranged under the sanding sole.

15. A compressible layer in its thickness direction as a component of a sanding machine as claimed in claim 1 wherein the compressible layer substantially takes the form of a sanding sole which is assembled from a first part and a second part.

16. Compressible layer as claimed in claim 15 wherein the compressible layer takes the form of the sanding sole with the omission of a substantially triangular sanding element.

17. Compressible layer as claimed in claim 16 wherein holes are arranged in the compressible layer, the position of which corresponds with the position of the debouchment of the channels into the parts of the sanding sole.

18. Compressible layer as claimed in claim 17 wherein positioning openings are arranged in the compressible layer in order to position the sanding element under the sanding sole.

19. Combination of a compressible layer as claimed in claim 15 and a sanding element arranged thereon wherein the sanding element is fixedly connected to the compressible layer.

20. Combination as claimed in claim 19 wherein the abrasive material of the sanding element is arranged directly onto the compressible layer.

21. A sanding element for use in a sanding machine as claimed in claim 1 wherein the sanding element substantially takes the form of a sanding sole which is assembled from a first part and a second part.

22. Sanding element as claimed in claim 21 wherein the sanding element is provided with a perforation line, which is displaced relative to the separation between the first part and the second part of the sanding sole.

23. Sanding element as claimed in claim 22 wherein the sanding element takes the form of the combined sanding sole with the omission of a commercially obtainable sanding element.

24. Sanding element as claimed in claim 21 wherein the sanding element takes the form of the combined sanding sole with the omission of a commercially obtainable substantially triangular sanding element.

25. Sanding element as claimed in claim 21 wherein holes are arranged in the sanding element, the position of which corresponds with the position of the debouchment of the channels into the parts of the sanding sole.

* * * * *